United States Patent [19]

Bishop

[11] 4,115,961

[45] Sep. 26, 1978

[54] VENT COVER

[75] Inventor: Robert L. Bishop, Ballwin, Mo.

[73] Assignee: West County Supply & Mfg. Co., Inc., Ballwin, Mo.

[21] Appl. No.: 819,981

[22] Filed: Jul. 28, 1977

[51] Int. Cl.[2] ..... E04D 13/08

[52] U.S. Cl. ..... 52/58; 52/199; 285/42

[58] Field of Search ..... 52/199, 219, 58–62; 285/42–45

[56] References Cited

U.S. PATENT DOCUMENTS

| | | | |
|---|---|---|---|
| 3,436,880 | 4/1969 | Kifer | 52/58 |
| 3,797,181 | 3/1974 | Nievelt | 52/199 |
| 3,977,137 | 8/1976 | Patry | 52/60 |

FOREIGN PATENT DOCUMENTS

| | | | |
|---|---|---|---|
| 1,408,897 | 10/1975 | United Kingdom | 52/199 |

*Primary Examiner*—J. Karl Bell

*Attorney, Agent, or Firm*—Paul M. Denk

[57] ABSTRACT

In a vent cover for use particularly with plastic piping, of the type that exhibits a high coefficient of expansion, the cover includes a sleeve that is rigidly fastened by means of an adhesive, or otherwise, through the agency of an adapter to the upper end of the vent pipe that projects through a flashing mounted upon the roof of a structure.

13 Claims, 5 Drawing Figures

VENT COVER

BACKGROUND OF THE INVENTION

This invention relates to a sheltering device, and more particularly pertains to a cover designed to operate effectively in preventing any leakage around a vent pipe and through its flashing even though significant disparity exists between the coefficient of expansions for the vent pipe and its accompanying and surrounding flashing.

Customarily, in the plumbing trade, and usual type of cast iron vent pipe extends upwardly through the roof of the building, and then a flashing, usually also constructed of some form of metal, such as lead, is provided for mounting upon the roof of a building, with the upper end of this type of standard flashing having an extending lead sleeve that is usually peened over by means of hammering or other bending and into the upper end of the cast iron vent pipe, thereby sealing the opening in the roof through which the vent pipe extends. This prior art type of flashing for the vent pipe has generally worked satisfactory, primarily because the various types of metals from which both the vent pipe and the flashing have been constructed are metals both having a very low, or somewhat equivalent, coefficient of expansion. But, over the past few years, there has generally been developing a market for the plastic type of piping that is now being frequently used in the plumbing industry, generally such piping being constructed from a polyvinyl chloride, or a compound of acrylonitrile-butadiene-styrene copolymers, generally identified in the trade as ABS. And, while this type of piping, thus far, has been found to work very effectively for plumbing installations, such pipe has a reasonably high coefficient of expansion which makes it very different to provide closure around the vent pipe when formed of one of these materials particularly where it extends through the building roof. For example, these vent pipes extend through a hole or aperture in the roof of the structure, and then have the old style of flashing, namely, one having an upper sleeve of lead, and which is sealed in place upon the roof, with said lead sleeve being peened over and around the upper edge of the plastic pipe. Then, and as frequently occurs, particularly in cold weather where the upper end of the plastic vent pipe may be exposed to very low winter temperatures, and with the vent pipe located within the building being exposed to the heated environment of the interior of the building, generally in the vicinity of 65° to 75° F., such has caused a high expansion of the plastic pipe. As a result, such a vent pipe expands considerably, while the lead flashing remains rather static, and with the only location for expansion of the vent pipe being in an upward shifting direction through the roof of a building, since usually its lower end is reasonably fixed to other plumbing installations, there is, therefore, no room for expansion downwardly. Consequently, the metal type flashing surrounding the upper end of the vent pipe is frequently broken loose and clear from its mounting upon the roof, causing a wide open gap in which the rain or other elements may easily flow as through the hole provided in the roof of the structure, and through which the vent pipe extends, eventually causing severe damage to the structure roof of the building within the vicinity of its said vent pipe.

As an example of the type of expansion problems encountered in forming vent pipes of the newer plastic type materials, it has been found that a vent pipe formed of polyvinyl chloride, and having a length approximating 35 feet when initially prepared for use, will expand as much as $\frac{7}{8}$ inch when exposed to temperatures in the range of 140° F., while at the same time, when exposed to temperatures in the vicinity of 33° F., may contract as much as $\frac{1}{2}$ inch. In addition, a pipe formed from ABS, and also having an initially and precisely cut length of approximately 35 feet, will expand well over $1\frac{1}{2}$ inches when exposed to temperatures in the vicinity of 140° F., and will contract as much as 1 inch when exposed to temperatures, as at the other extreme, around 35° F. Bear in mind that the temperatures selected for these tests are not too unsimilar to the temperatures normally encountered by that portion of a vent pipe that extends through the roof of a structure, since in the hot summer sun, temperatures may well reach in the vicinity of 140° F., at the roof line, while in the wintertime, temperatures within the central and northern parts of the United States easily average 33° F. And, expansions of the type previously identified, particularly under summer heat, and even when the pipe interiorly of the structure, where most of it is located, is exposed to temperatures in the vicinity of 70° F., when they expand the 1 inch or more in length, does have a very detrimental effect upon the lead flashing which had previously been peened around the upper edge of the pipe when installed. Thus, and particularly when expansion occurs, there is no place for the lead flashing to move but up, and when this occurs, it normally breaks loose from its mounting upon the roof structure, thereby readily exposing the gap between the roof and the enclosed vent pipe to rain, snow, or any other elements that eventually flow upon the surface of the roof.

The current invention is designed for use with the present lead roof flashing which is predominantly used in the trade, and at the same time, totally eliminates any leakage that occurs from the problems now associated with the usage of plastic pipe with such a lead flashing, since the problem of expansion and contraction has been alleviated through the structure of this invention.

Various prior art patents have given some consideration to the fabrication of shields for use in conjunction with roof vent pipes. For example, in the U.S. Pat. No. 3,797,181 to Nievelt, there is disclosed an outer cylindrical sheet that extends downwardly for flaring into an overlapping fashion and resting upon its modified form of sheet metal base, as shown. There are two significant differences between the shield of this prior art patent, and the current invention, in that the shield as shown is not fixed to any particular structure, but rather, simply rests upon the flashing. And, the shield is drapped over the vent pipe, and therefore, does not move with its expansion, as does the current invention.

The U.S. Pat. No. 1,010,100, to Wallace discloses a roof jacket for a ventilating pipe, wherein a sleeve is provided upon the top edge of the vent pipe 4, and then has another sleeve disposed for telescoping about the vertical pipe portion of the flashing. The cap of this jacket contains a series of interconnecting lugs that are designed for passing through various notches formed upon the pipe so that the cap may be rotated so as to lock it in place. And, a disc and stud are further provided for partially enclosing the center of the vent pipe as shown, and therefore, actually obstruct, rather than allow, the free flow of air out of the vent pipe. The patent is specifically upon an adjustable ice and frost proof flashing, its base having adjustability to compensate for varying slopes on roofs, and since no plastic pipe was available in 1911, Wallace had no concern with expansion matters. And, for this reason, this prior art patent shows its pipe 10 and section 9 in contiguity, unlike the present invention.

In any event, the structure of this Wallace jacket, particularly at its upper reaches, is quite dissimilar from the rather easily assembled adapter as designed and shown in the current invention. And, whereas Wallace is designed having contact between its sleeve and its pipe, the current invention avoids such.

Other prior art patents in this particular field include a U.S. Pat. No. 1,750,019 to Moore, the U.S. Pat. No. 1,923,220 to Lightbown, U.S. Pat. No. 2,307,269 to Hauser, and the U.S. Pat. No. 3,436,880 to Kiefer.

In view of the foregoing, it is, therefore, the principal object of this invention to provide a no leak expansion vent cover for use in conjunction with a current flashing provided upon the roof of a building structure.

Another object of this invention is to provide a vent cover which may be made in various sizes to be readily connected onto existing vent pipes and cooperate with the flashing so as to overcome problems associated with material expansion as currently exists.

A further object of this invention is to provide a vent cover which prevents lead flashings from being torn loose from their mountings upon roof structures.

An additional object of this invention is to provide a vent cover that allows for free expansion of the plastic vent stack or pipe, without any contact or cooperation needed for its functioning from the surrounding flashing, which will remain in a fixed position.

Another object of this invention is to provide a vent cover that is highly successful in operation and has received approved usage where ever installed.

Yet another object of this invention is to provide a vent cover that can be easily modified, at the job site, for mounting upon plastic vent pipes of a variety of sizes.

A further significant attribute of this invention is to provide a vent cover that allows for the full inside diameter of the vent pipe to vent its gases to the atmosphere.

A further object of this invention is to provide a vent cover that can be easily installed upon new construction, or modified in repair of existing vent structures, within a matter of minutes.

These and other objects will become more apparent to those skilled in the art upon reviewing the summary of this invention, and upon undertaking a study of the description of its preferred embodiment, in view of its drawings.

SUMMARY OF THE INVENTION

The present invention, briefly stated, is designed to overcome the type of problems that currently prevail particularly where vent structures of mixed materials have been assembled into homes and other building structures. As previously stated, the main problem is encountered by the use of plastic such as the polyvinyl or ABS pipe as the vent stack in conjunction with the standard lead roof flashing. Normally, a plastic pipe, such as constructed of polyvinyl chloride, extends up through the roof of a structure, forming the vent stack for the plumbing system arranged within the building, and under the teachings of this invention, an adapter, generally comprising either an annular, or other shape, form of articular ring may be joined onto the upper end of this existing stack, secured thereto, as by means of any form of an adhesive, such as an epoxy, or perhaps any form of plastic solvent, which is also used for connecting the two plastic components together, with an additional sleeve being connected slightly outwardly of the existing vent pipe, having no contact therewith, or its flashing, and depending downwardly from its also adhesive connection with the said adapter. Thus, a space is provided between the inner wall of the vent cover sleeve of this invention, and the outer surface of the existing vent pipe, with sufficient space being provided intermediate these two components so that the existing lead flashing, which will have been cut off a few inches below the top of the existing vent stack, will freely locate between these two components, and, preferably, not be in contact with either of the same. Thus, when expansion occurs, as to the vent stack, it, in addition to its connecting adapter and vent cover sleeve, will be free to project upwardly, or even contract slightly downwardly, depending upon the temperature and weather, without any obstruction to or with the existing flashing. Thus, the vent stack will be free to expand or contract depending upon the temperature of the ambient environment, with the upper end of the flashing always being disposed beneath and noncontiguous with the vent cover sleeve, and unattached to either said sleeve, or the vent pipe, and thereby conveniently prevent any rain or other moisture from getting into the flashing and seeping into the building structure, as through the previous cut out vent stack roof opening.

Even though this invention has been described as being conveniently used for solving any problems associated with the construction of a vent stack or pipe from plastic, it may even be used in conjunction with, as for example, a vent pipe formed of copper, which may also have some expandable characteristics, so as to overcome any objectionable features that may exist between the combined use of the copper vent stack in association with a lead flashing. Thus, the invention described herein operates effectively so as to provide a complete moisture barrier against the entrance of any rain, snow, or other water into a building structure, which has heretofore plagued the building and plumbing industry, particularly since the inception of usage of the plastic vent pipe.

DESCRIPTION OF THE PREFERRED EMBODIMENT

Figure 1:
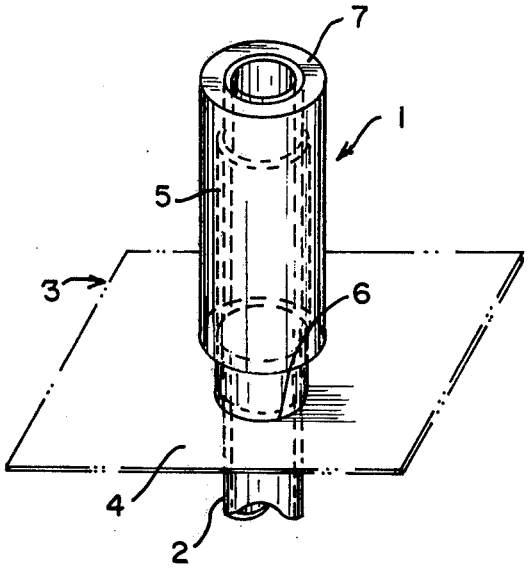
FIG. 1 provides an isometric view of the installed vent cover of this invention.
Figure 4:
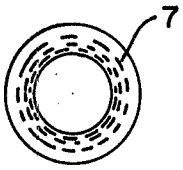
FIG. 4 provides a top view of the vent cover of this invention.

In the drawing, and in particular FIG. 1, there is disclosed the vent cover 1 of this invention which is designed for mounting upon the existing vent pipe or stack 2 projecting upwardly from the interior of a building structure. Normally, a standard lead flashing, as at 3, incorporates a base plate 4 that includes an upwardly extending sleeve type flashing portion 5, which as previously described, and because of its malleable characteristics, would under normal conditions be peened over the top of the vent stack 2, to form a seal between said vent stack and the roof through which it projects. Normally, the vent pipe 2 will extend through an aperture, as at 6, cut through the roof of the building, and it is this spacing within the aperture around the vent pipe 2 extending therethrough that must be sealed so as to prevent moisture from entering into the building, which has heretofore been accomplished through the use of a peened flashing, such as at 3. But, as previously described, peening a flashing over the type of plastic pipe, such as 2, encounters the expansion problems which results in an upward tearing loose of the flashing base plate 4 from the roof structure, thereby totally exposing the roof, at this location, and more particularly its aperture 3, to the drainage of rain or other moisture accumulating upon the roof of the building.

Figure 2:
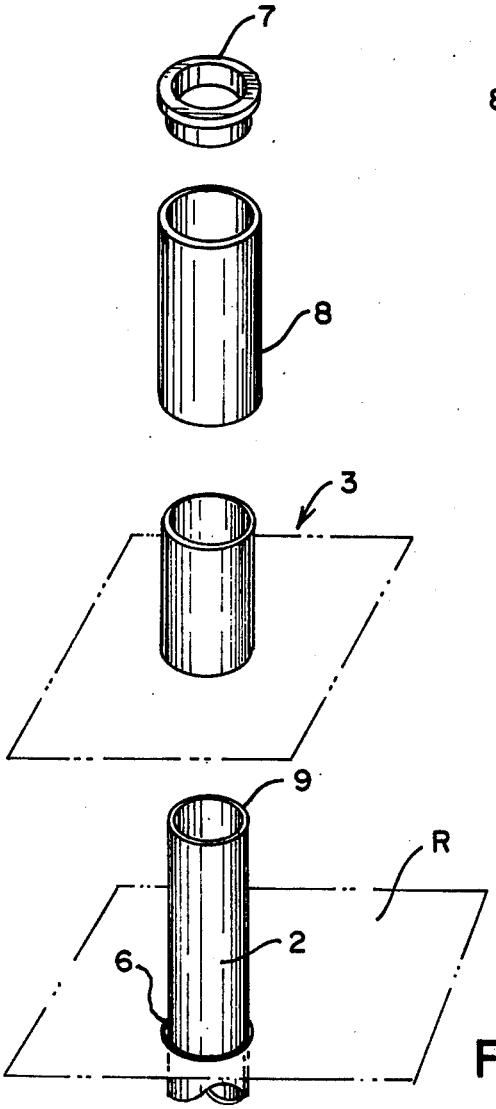
FIG. 2 provides an exploded view of the various components of this invention as may be used in association with the vent stack and flashing of a roof structure.

In this vent cover 1 of this invention, its design incorporates an adapter 7, which is designed for having connected to and depending therefrom a vent cover sleeve 8, which adapter 7 is designed for being connected to the top end, as at 9, of the stack 2. See also FIG. 2. Thus, the vent stack 2, in a new construction, does extend upwardly through the roof, as at 5, of the building, with the flashing 3 being slid over the vent pipe 2 and secured to the roof of the structure, and then a combined vent cover sleeve 8 will be adhesively fastened to its adapter 7, with the adapter being adhesively secured upon the top 9 of the existing vent stack 2, as aforesaid. Full clearance will be provided at all times between the sleeve 8 and the stack 2 of the flashing 3, so at no time will the flashing prevent a free shifting of the sleeve 8 during stack expansion. Furthermore, the sleeve 8 will be cut off high enough above the flashing base so as not to encounter it during expansion or to become frozen to it during the winter months. It may even be cut at other angles to conform to the contour of the roof.

Figure 3:
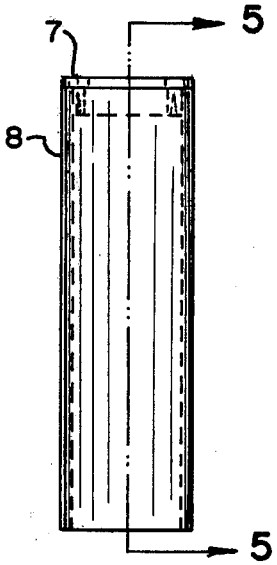
FIG. 3 provides a side view of the vent cover of this invention.

FIG. 3 discloses the relationship between the adapter 7, as when it is secured to its cover 8.

Figure 5:
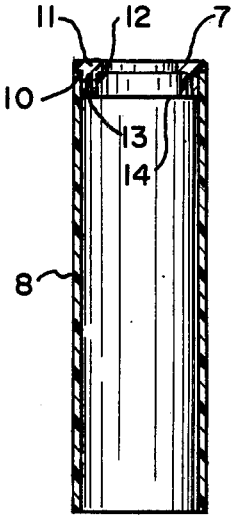
FIG. 5 furnishes a cross sectional view of the cover of this invention, taken along the line 5—5 of FIG. 3.

FIG. 5 discloses, in cross section, the configuration of the combined vent cover, comprising the adapter 7, and its sleeve 8, and it can be seen that the shoulder 10 is formed beneath the upper segment 11 of the adapter, so that the sleeve 8 may conveniently and snugly secure therewith, and an adhesive, or even a plastic solvent, such as currently available in the trade, can be lined about the upper edge of the sleeve 8, and the shoulder portion 10 of the adapter 7, so as to secure these two components together. And, another shoulder 12 is provided inwardly of the adapter 7, below its upper segment 11, and it is the location of this shoulder into which the upper end 9 of the vent stack 2 inserts, secured in place by means of some form of an adhesive or solvent, as aforesaid, such as an epoxy, for the purpose of securing the cover directly onto the top of the vent stack 2. And, since it is desirable to acquire a snug retention of the adapter 7 to both its sleeve 8, and the vent cover 2, a slot, as at 13, may be provided around the internal circumference of the downwardly extending portion 14 of the adapter, and provide some slight resiliency to this portion of the adapter, so that the sleeve may be tightly inserted onto its adapter 7, at the location of the shoulder 10, while at the same time, the upper end 9 of the vent stack 2 may also be tightly compressed into the adapter 7, as against its shoulder 12 due to the inherent resiliency provided in this downwardly extending portion 14 of the adapter, acquired through the agency of the annular members arranged intermediate the shoulders and the slot 13.

In addition to the use of this invention in new construction, the type of problems that are associated with previously installed vent pipes and flashings, of the peened type, can be remedied through usage of the herein disclosed invention. This can be done by the homeowner himself or by his plumber. For example, at any such previous installation, which may not be operating satisfactorily, mainly due to the expansion of either the plastic or copper vent stack above the flashing, when provided with the combined adapter 7 and sleeve 8 of this cover being adhesively connected to the top of the vent pipe 2, provides the means for quickly remeding the leakage problem that prevails. And, with the sleeve 8 being totally out of contact with the flashing 5, the elements, such as snow, cannot freeze these two components together, such as occurs during usage with the prior art type of devices. Thus, this invention is designed to provide a very simplified form of cover, formed only of two components, and which may be designed to various sizes so as to be readily affixed onto standard vent stacks of either the 2 inch, 3 inch, 4 inch, or even the 5 inch size as currently prevails in the trade, and totally eliminates the problems associated with vent stack expansion, which now is a detriment to the plumbing industry. And, various of the adapters may be secured together to provide for usage, for example, a 5 inch sleeve 8 of the cover with a 3 inch vent pipe. Normally, the adapters and sleeves are made in sets, but by combining adapters, a larger sleeve may be used upon a smaller than the standard vent pipe.

Various modifications or changes in the style of invention described herein may occur to those skilled in the art upon reviewing the subject matter of this disclosure. Such modifications or changes, if within the spirit of this invention, and encompassed by the scope of its claims, are intended to be protected by any U.S. patent issuing hereon. The description of the preferred embodiment is set forth for illustrative purposes only, and not meant to be limiting of the scope of the invention.

Having thus described the invention what is claimed and desired to be secured by Letters Patent is:

1. A vent cover for a plumbing installation and for use in preventing element leakage around a vent pipe formed of an expandable material and its flashing as formed from a material having a different coefficient of expansion than the said vent pipe, both said cover and pipe normally being disposed upon a roof structure, with the vent pipe being of the type that normally projects through its accompanying flashing, comprising, a sleeve having an internal diameter greater than the external diameter of the flashing and when disposed therearound capable of independent movement without obstruction therefrom, an adapter connecting with the upwardly disposed end of said sleeve and capable of attachment with the upper end of the vent pipe, said adapter including a shoulder being of a size to accommodate the upper end of the said vent pipe in mating engagement, said adapter having an opening therethrough and being of the same diameter as the internal diameter of the vent pipe upon which it mounts so as to provide no obstruction to the discharge of vent gases to the atmosphere, said adapter extending only a short distance above the vent pipe upon which it mounts, and said sleeve and adapter disposed for simultaneous movement with the expansion of the said vent pipe and shrouding the upper end of the flashing while being out of contact therewith for preventing the leakage of any elements therearound.

2. The invention of claim 1 wherein said vent cover and adapter are integral.

3. The invention of claim 1 wherein said adapter tightly engages with the upper end of said vent pipe.

4. The invention of claim 1 wherein said adapter includes a shoulder being of a size to accommodate the upper end of the sleeve in mating engagement.

5. The invention of claim 4 wherein said adapter tightly engages the said upper end of the sleeve.

6. The invention of claim 3 wherein said adapter includes another shoulder being of a size to tightly accommodate the upper end of the sleeve, the said another shoulder being arranged outwardly of the first said shoulder, and a slot being formed in the said adapter intermediate the said shoulders to render the adapter resilient in its tight adherence with the accompanying pipe and sleeve.

7. The invention of claim 3 and including an adhesive securing the adapter to the vent pipe.

8. The invention of claim 5 and including an adhesive securing the adapter to the sleeve.

9. The invention of claim 1 wherein there are a plurality of adapters interfitting together to accommodate a sleeve upon a vent pipe.

10. The invention of claim 1 wherein said adapter and sleeve are formed of a polymer.

11. The invention of claim 10 wherein said polymer is polyvinyl chloride.

12. The invention of claim 1 wherein said adapter and sleeve are free to expand and shift with the vent pipe without contact or interference with its surrounding flashing.

13. The invention of claim 12 wherein said adapter has at least a minimum interior diameter equivalent to the interior diameter of the vent pipe so as to provide a full unobstructed clearance for passage of vent gases through the said vent pipe.

* * * * *